United States Patent [19]

MacDonald et al.

[11] 3,955,864

[45] May 11, 1976

[54] MOLDED FOLDABLE CABINET

[76] Inventors: Kenneth A. MacDonald, 251 York St., Canton; Edward J. MacDonald, 180 Border St., Scituate, both of Mass.

[22] Filed: Mar. 21, 1974

[21] Appl. No.: 453,331

[52] U.S. Cl. ..... 312/258; 312/108; 312/262; 312/264; 312/307; 312/313

[51] Int. Cl.[2] ..... A47B 43/00; A47B 46/00; A47B 47/04; A47B 88/18

[58] Field of Search ..... 312/5, 258, 263, 195, 312/213, 262, 315

[56] References Cited

UNITED STATES PATENTS

| | | | |
|---|---|---|---|
| 242,355 | 5/1881 | Nicholas | 312/262 X |
| 442,664 | 12/1890 | Elsner | 312/262 |
| 1,199,293 | 9/1916 | Montgomery | 312/213 X |
| 3,193,341 | 7/1965 | Preston | 312/315 X |
| 3,752,552 | 8/1973 | MacDonald | 312/258 |

FOREIGN PATENTS OR APPLICATIONS

| | | | |
|---|---|---|---|
| 1,371,349 | 7/1964 | France | 312/258 |

*Primary Examiner*—Paul R. Gilliam
*Assistant Examiner*—Carl F. Pietruszka
*Attorney, Agent, or Firm*—Morse, Altman, Oates & Bello

[57] ABSTRACT

A cabinet of the sort used as a vanity, or the like, is molded in several components connected in articulated relation for shipment in a flat, folded condition yet readily erected for installation. The components include a front panel formed with integral hinges connected to cooperating integral hinges formed on a pair of side panels adapted to fold over against one another and the front panel when the cabinet is in a collapsed position. A pair of shelves is provided, each with integral hinge pins pivotally engaging the front and side panels by sockets formed between the side panels and the front panel, both shelves being foldable against the front panel when collapsed. A back panel is provided for closing the rear of the cabinet when erected and means are provided for re-inforcing and supporting the various components from damage during shipment.

4 Claims, 15 Drawing Figures

FIG. 4
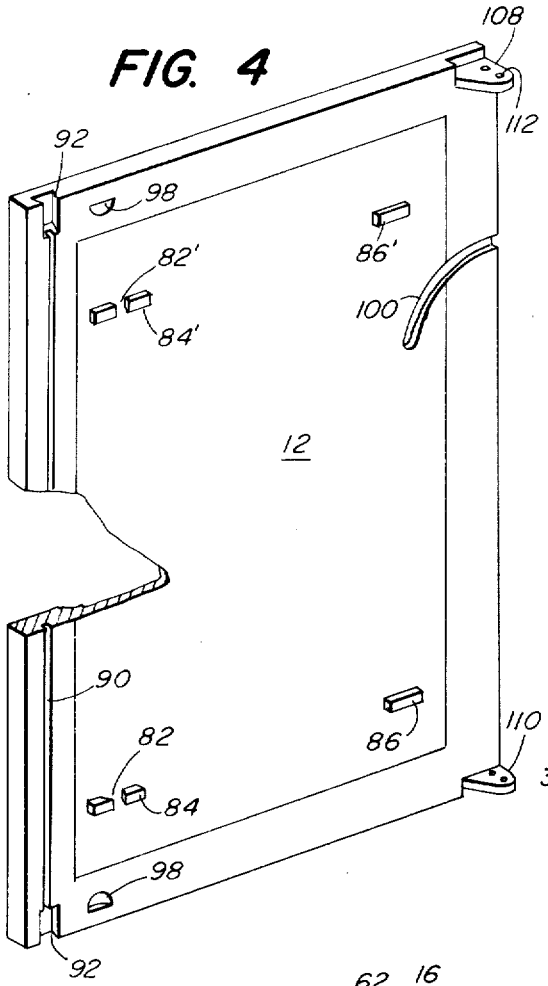
FIG. 3
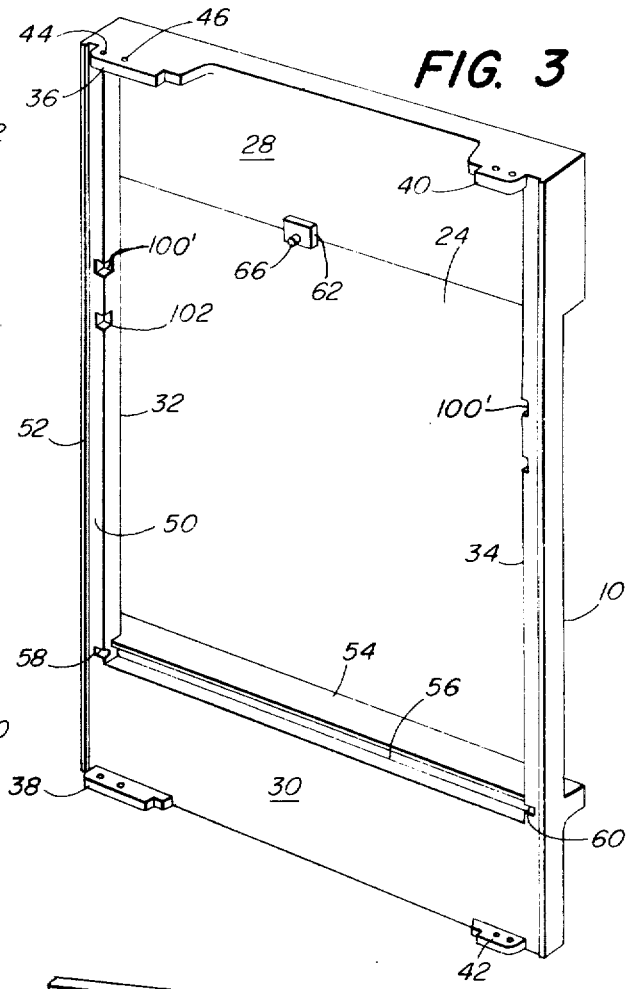
FIG. 14
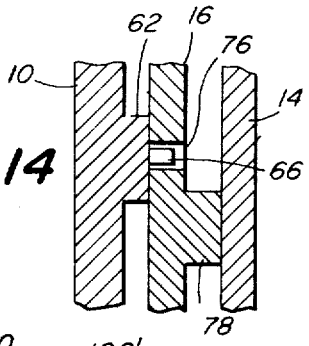
FIG. 5
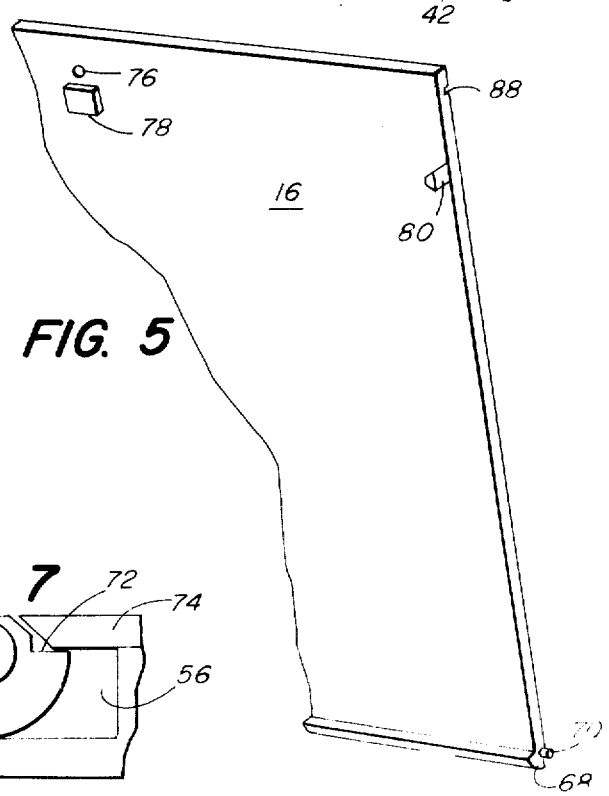
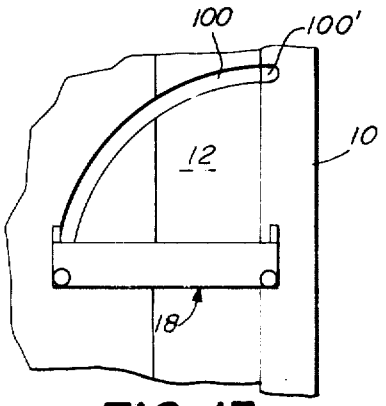
FIG. 13
FIG. 7
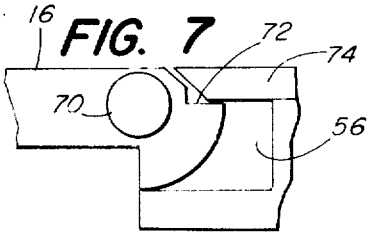

MOLDED FOLDABLE CABINET

BACKGROUND OF THE INVENTION

1. Field Of The Invention

This invention relates generally to foldable cabinets and more particularly is directed towards a new and improved foldable cabinet fabricated almost entirely from molded plastic components adapted for folding into a collapsed position for storage or shipment and readily opened for erection and installation.

2. Summary Of The Prior Art

In U.S. Pat. No. 3,644,011 dated Feb. 22, 1972 entitled "Collapsable Cabinet" there is disclosed a cabinet of the sort used in kitchens, bathrooms and the like and which is adapted to be folded into a compact flat condition for the purpose or reducing storage space requirements as well as reducing shipping costs by the manufacturer. Folded cabinets of this type also are more easily transported by individual purchasers since they are more compact and easier to handle than conventional cabinets.

In U.S. Pat. No. 3,752,552, dated Aug. 14, 1973 entitled "Folding Cabinet of Molded Construction" there is disclosed a folding cabinet of the foregoing type in which the components, including the various panels, doors, shelves, etc., are molded almost entirely from plastic in order to reduce the manufacturing steps and to make the cabinet more suitable for mass production operations.

It is a general object of the present invention to provide improvements in foldable cabinets fabricated primarily from molded components. It is a more particular object of this invention to provide a collapsible cabinet of molded plastic components wherein the parts are formed in such a manner as to cooperatively reinforce and support one another, especially when folded so as to minimize the risk of damage to the parts during shipment.

SUMMARY OF THE INVENTION

This invention features a foldable cabinet fabricated predominately from molded plastic components, comprising a front panel formed with at least one opening therein, at least one door hinged to the front panel for closing said opening and a pair of rearwardly extending side panels hinged to the front panel and adapted to fold in against the front panel in over-lapping offset relation when in a collapsed folded condition. Integral and uniquely formed hinges support the folded side panels so as to prevent damage to the cabinet and especially the hinges, during shipment. Two shelves, one extending substantially the full depth of the cabinet and the other extending for only a portion thereof, are hinged in spaced relation to the front panel and between the forward edges of the side panels by means of pins mounted in cooperating sockets formed in the front panel. A back panel is slidably mounted in preformed grooves located adjacent the rear edges of the side panels and reinforcing pads are formed integral with the shelf for supporting the shelf in a stabilized position while folded.

BRIEF DESCRIPTION OF THE DRAWINGS

FIG. 3 is a rear perspective view of the front panel portion of the cabinet, FIG. 4 is a view in perspective of one of the side panels, FIG. 5 is a fragmentary view in perspective of the cabinet lower shelf, FIG. 7 is a detailed elevation of the hinged portion of the lower shelf, FIG. 13 is a detailed side view showing the mounting and folding arrangement of the upper shelf, FIG. 14 is a detailed sectional view showing the support arrangement amongst the several panels when folded, and, FIG. 15 is a detail sectional view showing the rear panel assembly.

DETAILED DESCRIPTION OF THE PREFERRED EMBODIMENT

Figure 1:
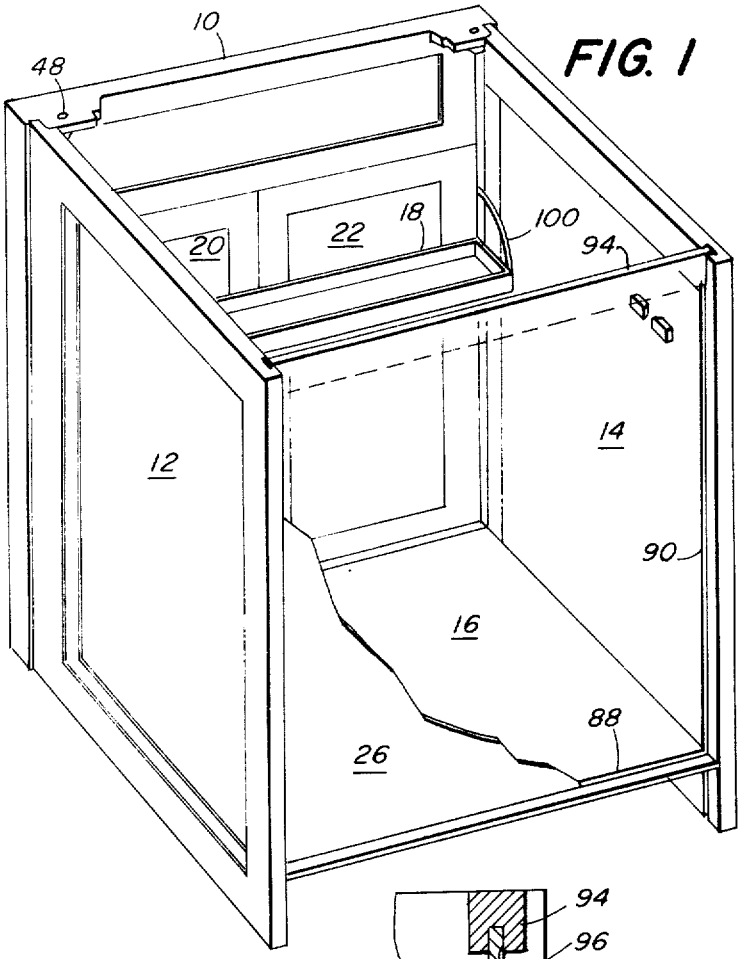
FIG. 1 is a rear perspective view, partly broken away showing a molded foldable cabinet made according to the invention.

Referring now to FIG. 1 of the drawings, the illustrated cabinet is of the type commonly used as a vanity for bathrooms or as a kitchen cabinet and is comprised of articulated panel members adapted to fold in against one another into a compact collapsed condition for convenience in storage and shipment yet easily unfolded into an open position for erection and installation. The cabinet is generally organized about a front panel member 10 having a pair of rearwardly extending side panel members 12 and 14 hinged to the side edges of the front panel member and a rearwardly extending full shelf 16 hinged horizontally across the lower rear portion of the front panel. A smaller upper shelf or tray 18 is hinged horizontally across the center portion of the front panel and, in the illustrated embodiment, a pair of door panels 20 and 22 are hinged to the sides of the front panel across an opening 24 formed in the front panel member. The cabinet also includes a rear panel 26 which is set into position when the cabinet is erected.

In the preferred form of the invention, the various panels are fabricated from plastic, preferably a structural foam plastic, using molding techniques such as injection molding or the like. Structural foamed polystyrene, for example, may be employed to advantage since such material is strong, hard and presents a wood-like appearance in a finished state. Such material is available in a variety of colors or may be stained or otherwise finished as desired.

The front panel 10, as best shown in FIG. 3, is of a one-piece molded construction comprised of an upper cross panel 28 and a lower cross panel 30 connected by vertical supports 32 and 34 defining the opening 24. Formed adjacent each corner at the top and bottom edges of the front panel 10 are integral hinge members 36, 38, 40 and 42 projecting rearwardly from the rear face of the panel 10 and formed each with a pair of spaced holes 44 and 46 to accommodate hinge pins 48.

Figure 11:
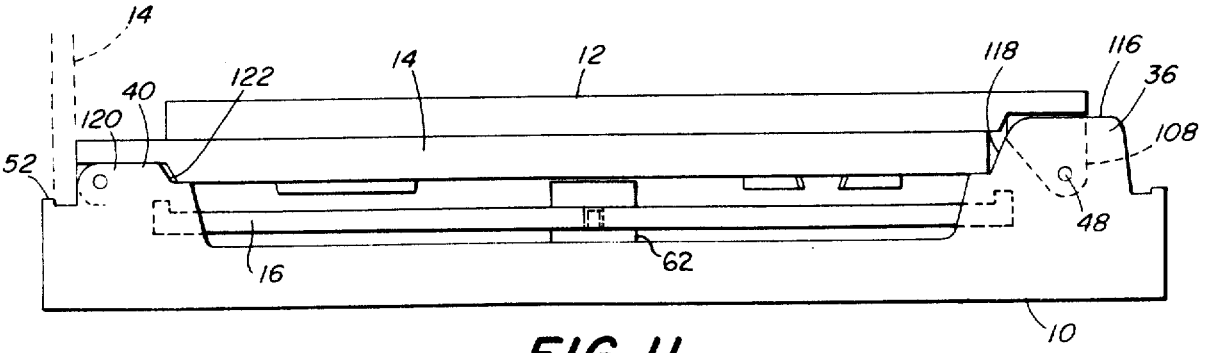
FIG. 11 is a top plan view showing the cabinet in a folded condition.

The hinge members 36–42 are located slightly inboard of the vertical supports 32 and 34 each of which is formed with a flat rear face 50 along the outer edge of which is formed an elongated lip 52. The flat face and lip cooperate with the side panels 12 and 14 not only to serve as a stop for these side panels but also to hide the joints between the side panels and the front panel when the cabinet is erected. The lip 52 also helps to straighten any warpage which may develop in the side panels. The straightening effect is achieved by the lip 52 which will extend along the outer forward edge of the side panels 12 and 14 when they are in their open position as suggested in FIG. 11. Thus, when the side panels are open their forward edges will butt against the faces 50 and the side edges will be within the rib to provide vertical restraint to the side panels as best shown in FIGS. 1 and 11. The lip also produces a shadow line which also tends to hide the joints.

The lower cross panel 30 is formed at its top portion with a forwardly extending ledge portion 54 in the rear face of which is formed a transverse groove 56 terminating at each outer end in oppositely facing sockets 58 and 60 which also open to the rear face 50 of the vertical supports 32 and 34 for reasons that will presently appear. The function of the grooves 56 and the sockets 58 and 60 is to pivotally support and engage the full lower shelf 16 as will be described more fully below.

In the rear face of the upper cross panel 28 there is formed an abutment 62 which extends below the edge of the panel 28 partly into the opening 24 at the top center thereof. The abutment serves as a door stop for two doors 20 and 22 which are hinged to the supports by conventional metal hinges 64 or pin-type hinges may be employed with pins, one of which is spring-loaded and the other fixed, at the top and bottom edges of the door in cooperating sockets formed in the front panels on opposite sides of the door openings. The abutment 62 is also formed with a rearwardly extending stub post 66 the function of which will be described below.

The full lower shelf 16, as best shown in FIG. 5, is of one-piece construction rectangular in outline and formed along its leading edge where it joins the front panel 10 with an offset arcuate rib 68, the curved outer face of which is generally concentric with the axis of a pair of co-axial lugs or pivot posts 70 extending from both side edges of the shelf adjacent the leading end thereof. The forward end of the shelf 16 is formed with a right angular notch 72 extending across the full width thereof and is of a depth substantially corresponding to the thickness of a wall section 74 forming the transverse groove 56 whereby, when the shelf 16 is lying in a horizontal flat position, the upper surface of the shelf will be flush with the upper surface of the ledge portion 54. The notch 72 serves to position one end of the shelf with respect to the front panel and to cooperate with the groove 56 to permit a hinging action therewith.

The rib 68 supports the front edge of the shelf whether the shelf is in a horizontal or vertical position to prevent strain being placed on the post 70. Thus, if the cabinet should be dropped during shipment, the post will not break. The rib also cooperates with the groove 56 to straighten any warpage that may develop in the shelf.

The shelf 16 is also formed with a hole 76 near the rear center edge thereof to receive the post 66 extending from the abutment 62 when the shelf is folded flat against the front panel 10. The function of the post is to support the shelf so as to alleviate strain from the pivot posts 70 should the cabinet be stored or shipped upside down or should the cabinet be dropped while handling, particularly on edge. The shelf 16 is also formed with an integral pad 78 in close proximity to the hole 76 and the function of the pad is to prevent the shelf 16 from swinging when folded. As best shown in FIG. 14, the pad 78 engages the inner face of the folded side panel 14 in such a manner that the front panel 10, the shelf 16 and the side panel 14 all fold neatly together in stacked arrangement holding the shelf snugly from both front and rear.

The pivot posts 70 are received in the sockets 58 and 60 at each end of the groove 56 and are locked in position by means of the leading edges of the two side panels 12 and 14 when the sides are folded outward into an erected, open position. The side panels cooperate with the front panel to form a simple, highly efficient hinged socket for the pivot posts 70. When initially assembling the components the shelf is simply placed against the front panel with the posts 70 placed in their respective sockets. When the side panels are subsequently connected to their respective hinges, the shelf panel is prevented from dropping out of position.

Towards the rear part of the shelf 60 at each side edge thereof there is a downwardly extending tongue 80 which serves to lock into a cooperating dovetailed groove or slot 82 formed in an integral shoulder 84 molded to the inner face of the side panels 12 and 14. The tongue 80 fits into the dovetailed slot 82 so as to hold the edge of the shelf flush against the inner face of the side panels and also the shoulder 84 supports the shelf in a horizontal position. A second shoulder 86 is molded into each side panel towards the front edge to provide additional horizontal support. In practice, a second set of shoulders 84' and 86' may be molded to the upper inner face of side panels in the same relative positions as the lower shoulders to serve the same function as the lower shoulders should the side panels 12 and 14 be reversed in position. This arrangement allows a single side panel to be mounted to either side of the front panel thus reducing mold costs and tooling requirements.

Figure 8:
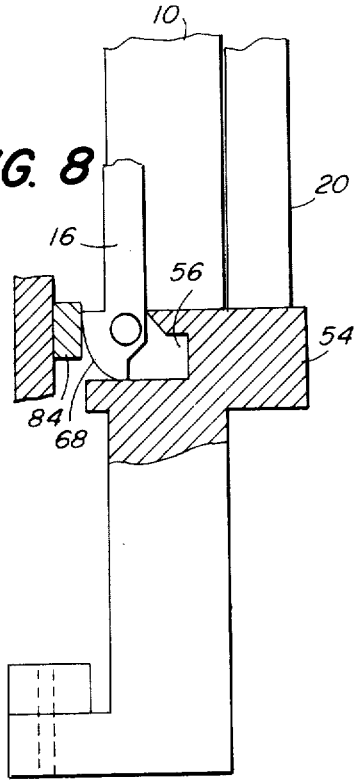
FIG. 8 is a fragmentary sectional view in side elevation showing the lower shelf folded in position with respect to the front and side panels.
Figure 15:
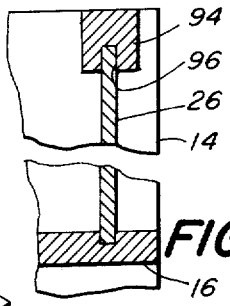

The main lower shelf 16 is also formed with a transverse groove 88 along the marginal rear edge thereof and in line with a vertical groove 90 formed along the inner vertical rear margin of each side panel 12 and 14. The grooves 88 and 90 are provided to receive the edges of the rear panel 26 which is dropped into position after the side panels are folded out and the main shelf is dropped down between the side panels. The rear panel 26 is merely slipped down between the grooves in each side panel and supported at its lower edge by the groove 88 in the main shelf 16, as best shown in FIG. 15. The upper and lower ends of the groove 90 terminate in dovetailed slots 92 adapted to receive the dovetailed tongue of a cross brace 94 which is dropped down onto the upper edge of the rear panel 26. In practice, the cross brace 94 is formed with a longitudinal lower groove 96 (FIG. 15) which receives the top edge of the rear panel 26. Not only do the shoulders 84 and 86 support the main shelf 16 in its horizontal position but also bear against the arcuate rib 68 on the shelf 16 when it is folded upright as in FIG. 8. The shoulders 84 and 86 press in against the rib 68, sandwiching the rib in position, holding it against displacement and minimizing the risk of damage to the shelf and particularly the pivot posts 70 should the unit be dropped or mishandled during shipment.

The side panels 12 and 14 are also formed with indents 98 in the upper and lower margins thereof to serve as starting holes for screws to fasten a counter top or the like permanently to the erected cabinet or to fasten it to the floor.

Figure 12:
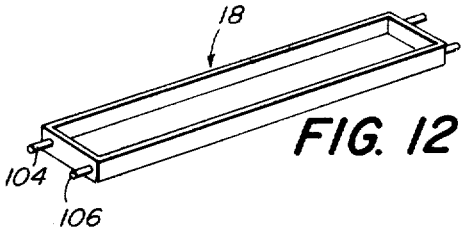
FIG. 12 is a perspective view of the upper shelf.
Figure 6:
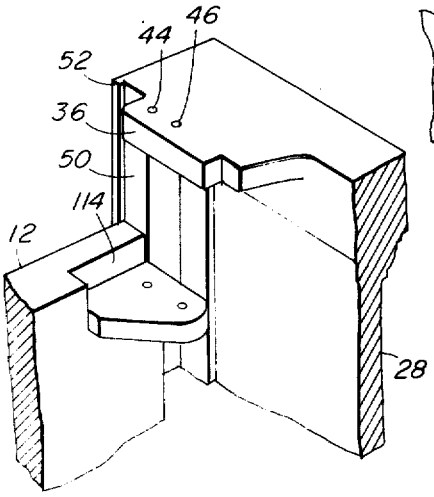
FIG. 6 is an exploded fragmentary perspective view showing the front panel and side panel assembly.
Figure 2:
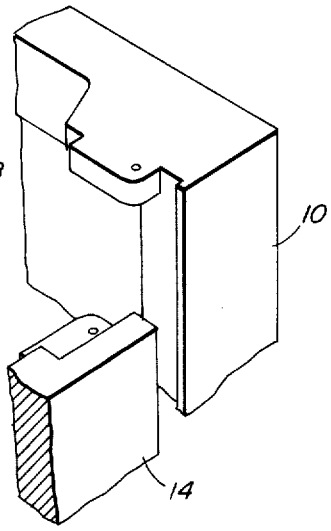
FIG. 2 is a view in perspective of a door panel employed in the cabinet of FIG. 1.
Figure 2:
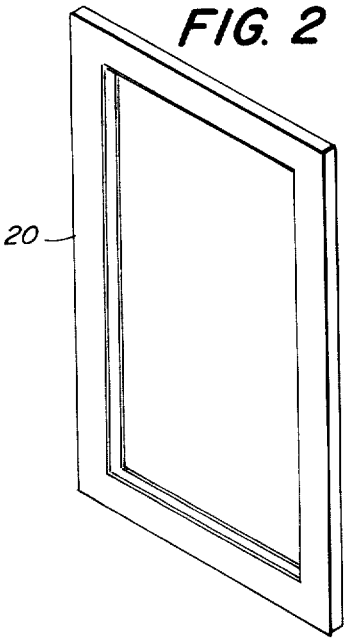
Figure 10:
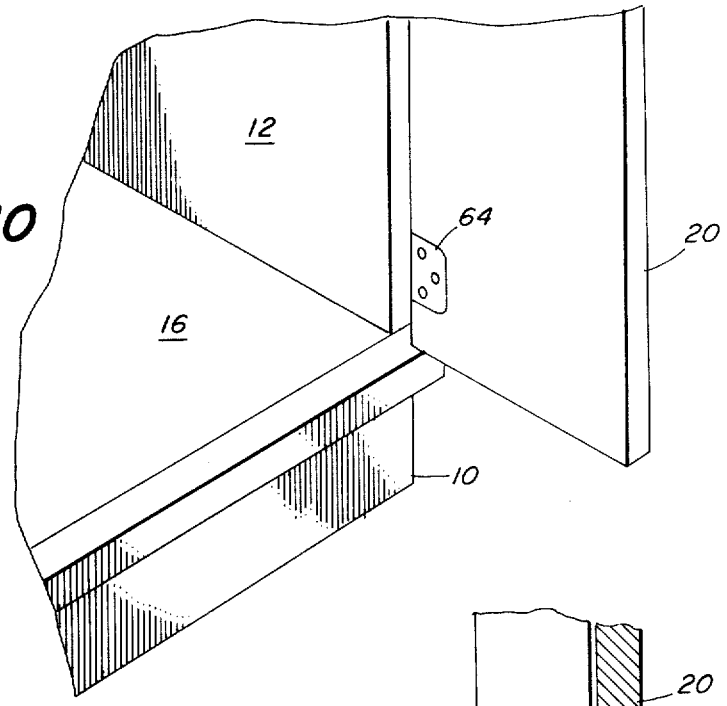
FIG. 10 is a fragmentary front perspective view showing details of the cabinet assembly.
Figure 9:
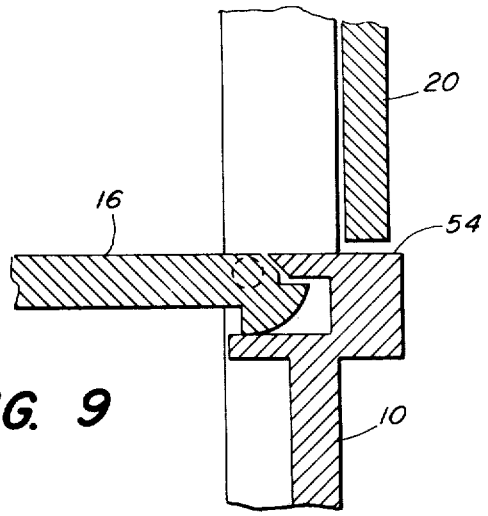
FIG. 9 is a view similar to FIG. 8 but showing the shelf in an open position.

Each side panel is also formed with an arcuate groove 100 originating at the forward edge of each side panel in the upper mid-portion thereof and extending inwardly and downwardly to a point inboard thereof and opposite a notch 102 formed in the supports 32 and 34. The notch 102 and groove 100 serve to support the medial shelf or tray 18, as best shown in FIG. 12 and FIG. 13. The upper forward end of the groove 100 aligns with a groove extension recess 100' formed in the front panel 10 above the notch 102. The shelf 18 preferably is in the form of a shallow tray having integral pivot pins 104 and 106 extending from each end thereof. The tray 18 is mounted by placing the pins 104 in the notches 102 of the shelf support and locating the pins 106 in the grooves 100. When mounted in this fashion, the tray can be folded with the pins 106 received in the recess 100' flat against the front panel when the unit is folded and may be readily dropped down to a normal open position as shown in FIG. 1 with the pins 106 riding along the arcuate groove 100. The tray typically may be on the order of perhaps 6 inches from front to back and extends the full width of the cabinet. Surrounding walls are perhaps ⅜ inch in height and may be used for storing various small articles.

Both side panels 12 and 14 are formed with integral hinge members 108 and 110 at the top and bottom thereof adapted to be connected to the hinge portions 36 through 42 of the front panel by means of hinge pins 48. The hinge members 108 and 110 are in the form of inwardly extending ears formed with pin holes 112 to receive the hinge pin extending through either of the holes 44 or 46 of the front panel hinge pieces, depending upon the hinging arrangement desired. Above the hinge part 108 and below the hinge part 110 is a recess 114 which accommodates the hinge members of the front panel. The double hole arrangement is provided in the hinge members to allow the side panels to fold over one another in an offset parallel manner as suggested in FIG. 11. This would not be possible if the side panels were hinged in the same manner on each side since they overlap one another when folded.

In order to provide support for the side panels, particularly in the hinge area when folded, the front panel hinge members 36 through 40 are formed so as to provide both lateral and transverse support for the side panels. As best shown in FIG. 11, the hinge member 36 is formed with a rearwardly extending nose portion 116 which fits neatly into the recess 114 of the side panel when the side panel is folded. The nose portion 116 is also formed with a notched inner edge 118 which engages the free end of the side panel 14 when it is folded in against the shelf and front panel. This notched portion 118 thus provides support to the free end of the panel 14 when folded with the hinged end of the panel 14 supported by a nose portion 120 formed in the hinge 40. The nose portion 120 also forms into a notched inner edge 122 to engage the rear edge of the recess 114. The nose portions of the hinges in their mating engagement with the opposite side edges of the side panels provides support for the side panels, particularly protecting them against damage should the unit be dropped on edge during shipment.

Since the parts may be injection molded they may be produced more quickly at a lower cost per unit than conventional cabinets. The resulting cabinet is of rugged construction which will display an appearance quite similar to conventional wooden cabinets. The units have the further advantage of being able to be folded flat for reducing warehouse requirements and also are far more conveniently shipped and at a lower cost than a standard erected cabinet insofar as they are smaller, easier to handle and require less space. The components are designed so as to minimize the risk of damage particularly to hinge parts while in shipment since the components are self-supporting by reinforced cooperating construction.

Having thus described the invention what we claim and desire to obtain by Letters Patent of the United States is:

1. A foldable cabinet, comprising a. a front panel formed with a rectangular opening therethrough, b. at least one door hinged to said front panel across said opening, c. rearwardly extending fixed hinge members formed integral with said front panel adjacent each side thereof, d. a side panel hinged on each side of said front panel and formed with inwardly extending fixed integral hinge members in registration with said front panel hinge members adapted to form cooperating hinges and a pin engaging each cooperating front and side panel hinge members for pivotal engagement therewith, e. said side panels being formed with integral oppositely facing shoulders substantially co-planar with the lower edge of said front panel opening, f. a movable shelf panel dimensioned to fit between said side panels when said side panels are open, said shelf panel being supported by said shoulders and having its leading edge against said front panel, g. said front panel hinge members being formed with notches defining co-planar supporting surfaces parallel to the front panel and adapted to engage opposite marginal portions of one of said side panels when folded there-against, said notches also defining oppositely facing surfaces extending rearwardly from said co-planar surfaces in position to laterally support the free and hinged ends of said one side panel when folded and the hinged end of the other side panel when folded.

2. A foldable cabinet according to claim 1 including cooperating lock means formed integrally with said shelf panel and said side panels, said lock means including a dove-tailed tongue formed on each side edge of said shelf panel, each of said side panel shoulders being formed with a mating dove-tailed groove adapted to engage said tongue in locking engagement therewith.

3. A foldable cabinet according to claim 1 wherein said side panels are formed with integral bosses extending from the surface of said side panels and defining said shoulders, said bosses being of a thickness sufficient to extend into contact with the lower end of said shelf panel when said shelf panel is folded up against said front panel, said shelf panel being formed with a spacer pad near the rear end thereof and positioned to bear against the face of one of said side panels when folded.

4. A foldable cabinet, comprising a. a front panel formed with a rectangular opening therethrough, b. at least one door hinged to said front panel across said opening, c. rearwardly extending hinge members on said front panel adjacent each side thereof, d. a side panel connected to said hinge members along each side of said front panel whereby said side panels may be folded in overlapping relationship against said front panel, e. a movable full shelf panel dimensioned to fit between said side panels when open and extending to the rear edges thereof, f. means supporting said shelf panels to said side panels when open, g. said side panels being formed with matching curved grooves extending each in an arcuate path from the forward edge thereof in an arc of substantially 90° inwardly and downwardly along the inner face of said panel, said front panel being formed with a first pair of recesses along the hinge sides thereof adjacent said opening and substantially in the same plane as the lower inner end of said grooves and a second pair of recesses along the hinge sides thereof adjacent the top of said groove, and, h. a rectangular tray formed with spaced parallel lugs, extending from each corner thereof and defining a pair of lugs at each end of said tray with one lug of each pair of lugs mounted in said groove and the other lug of each pair of lugs mounted in said recess whereby said tray may be pivoted from a folded upright position when said cabinet is folded to a horizontally extending position when said cabinet is open, the width of said tray generally corresponding with the width of said shelf and the depth of said tray generally corresponding to the distance between said first and second recesses.

* * * * *